US011703066B2

(12) United States Patent
Flatt

(10) Patent No.: US 11,703,066 B2
(45) Date of Patent: Jul. 18, 2023

(54) HYDRAULIC POWER PACK SYSTEM

(71) Applicant: FOI GROUP, LLC, Dallas, TX (US)

(72) Inventor: David Shawn Flatt, Forney, TX (US)

(73) Assignee: FOI GROUP, INC., Dallas, TX (US)

( * ) Notice: Subject to any disclaimer, the term of this patent is extended or adjusted under 35 U.S.C. 154(b) by 0 days.

(21) Appl. No.: 17/524,179

(22) Filed: Nov. 11, 2021

(65) Prior Publication Data

US 2023/0143865 A1 May 11, 2023

(51) Int. Cl.
*F15B 11/072* (2006.01)
*F04B 25/00* (2006.01)

(52) U.S. Cl.
CPC ..... *F15B 11/0725* (2013.01); *F04B 25/005* (2013.01)

(58) Field of Classification Search
CPC .. F15B 11/072; F15B 11/0725; F04B 25/005; F04B 25/02; F04B 25/04
See application file for complete search history.

(56) References Cited

U.S. PATENT DOCUMENTS 4,623,124 A * 11/1986 Lewis ..... B66D 1/00 254/350
5,678,982 A * 10/1997 Schwaiger ..... F15B 1/02 417/63
8,328,530 B2 * 12/2012 Fronzoni ..... F04B 23/023 417/234
8,545,188 B2 * 10/2013 Infanger ..... F04B 49/002 123/198 C
2016/0230786 A1 * 8/2016 Nema ..... F15B 3/00
2019/0366132 A1 12/2019 Knoll et al.

FOREIGN PATENT DOCUMENTS

| | | | | |
|---|---|---|---|---|
| CN | 112377482 | A | 2/2021 | |
| DE | 202019002278 | U1 | 5/2020 | |
| EP | 1972362 | A2 * | 9/2008 | ..... A62B 3/005 |
| EP | 3749489 | A1 | 12/2020 | |
| RU | 201109 | U1 | 11/2020 | |
| WO | 2021070828 | A1 | 4/2021 | |

OTHER PUBLICATIONS

Patentability Search Report, Gas Powered Hydraulic Unit, dated Jul. 28, 2021.

* cited by examiner

*Primary Examiner* — Michael Leslie
(74) *Attorney, Agent, or Firm* — Katten Muchin; Rosenman LLP

(57) ABSTRACT

This invention is a portable pneumatically driven pressure intensifying positive displacement hydraulic power unit that can be transported in a bag or backpack and carried or worn by the user. The device can be powered by any suitable high pressure gas that is preferably contained in a small pressure vessel for portability. The device can be used to supply high pressure hydraulic fluid to tools with a wide range of uses in many fields including construction, industrial, breaching, and emergency service situations. This novel device does not require an electric or fuel powered hydraulic fluid pumping system, which allows it to be very portable and used in almost any environment (e.g., hazardous atmosphere or under water) without being tethered to an electric or fuel powered power source.

33 Claims, 8 Drawing Sheets

HYDRAULIC POWER PACK SYSTEM

BACKGROUND

High pressure, high load, compact, interchangeable hydraulic tools are commonly used in many industries, these tools produce high forces from small diameter cylinders supplied with high pressure hydraulic fluid that's typically in the 10,000 pounds per square inch (psi) range. Hydraulic fluid flow and pressure is usually delivered to the cylinders by hydraulic power units incorporating low flow high pressure pumps coupled to a motor that is powered by electricity or fuel. An alternative method of generating a low fluid flow with pressures high enough for use with these types of cylinders is with hand pumps, which are similar in function to a hydraulic bottle jack. Delivering 10,000 psi hydraulic fluid to these tools is relatively easy from large stationary pumping systems with virtually unlimited power sources, but the weight, size, and power requirement of these systems prohibit their ability to be carried by a user and used as portable power sources.

Portable backpack hydraulic power units are usually powered by a low power small electric motor driven hydraulic pump and usually use rechargeable batteries to power the motor, these systems have several limitations. Nominal battery charge must be maintained to run the pump at full pressure and flowrate, and recharge rates can be slow typically around 30-60 minutes per battery pack. When the batteries do need to be recharged if electricity isn't currently available, the unit can become useless in emergency situations. Batteries have a limited energy capacity with a high density to power ratio, carrying multiple spare batteries in a backpack (whether they are charged or discharged) can get heavy for the user.

Maximum hydraulic pressure and flow from hydraulic pumps is limited by the mechanical power available from the electric motor that drives the pump, and the electric motor is limited by the power available from the electric source. As batteries loose charge the power delivered to the pump will diminish which will reduce pump flow rates and pressure to the system. Electric motor driven hydraulic systems are not suitable for wet or underwater environments or flammable and explosive areas. Electric motor driven pumps can also be noisy and in some covert situations a low noise alternative could be more desirable.

Emergency services normally use fueled engine driven hydraulic power units to actuate lifesaving hydraulic tools (e.g., "The Jaws of Life" used by Firemen). These engine powered systems can be large and heavy which limits their use mostly to ground applications like vehicle crash sites, and the hand held tools can be bulky, heavy and strenuous for long term use. A light weight hydraulic power pump in a backpack could be worn and used with hand held hydraulic tools to open doors, lift heavy debris, or cut metal (e.g., Locks, bolts, rebar, or cable) not only on the ground but also easily carried in multistory buildings or other remote structures.

Breaching is a term that is used by police swat teams and military special forces that are trained to enter fortified buildings or structures, this is normally done by forcing a locked door open by some means of force. Breaching doors can be accomplished several ways with explosives, shotgun rounds, gas or thermite cutting torches and many different hand tools like crow bars, battering rams, and cutting tools. The drawbacks to some of these methods is they make very high sounds and pressure waves that require highly trained and blast protected personnel to use them. Breaching explosives can be dangerous to the users and bystanders and take a lot of time to setup on a door by a team and then move to a safe distance detonate and then run back to the breached entry. Shotgun rounds also make high amount of noise and can take multiple rounds to breach a door. Cutting torches are quieter than explosives and shotguns but they make a lot of smoke and heat, which can fill a building hallway with blinding smoke. Portable hydraulic power units with spreading wedges, cutting or prying tools are also used to breach doors. The hydraulic tool is usually wedged into the door jam and when the pump supplies pressure to the tool it expands and either breaks the lock or the door frame and the door can be pushed open. Battery powered hydraulic tools are limited in available power, and batteries have a maximum amperage discharge rate which limits fluid pumping horsepower and fluid flowrates at high pressures making tool operation speed slow.

Demolition, construction and industrial workers use high pressure hydraulic tools on a daily basis. Industrial hydraulic pumping systems are usually large, heavy, stationary, and normally used in a factory, but there are uses for onsite portable high pressure hydraulics; lifting and leveling structures, cable cutting, bar cutting, bolt cutting, clamping and pressing are a few of the industrial applications.

SUMMARY

The hydraulic power pack of the disclosed invention offers a portable high pressure hydraulic system that can be powered by interchangeable portable compressed gas supply vessels. With its portability and being powered by compressed gas it can be carried by a single user, and be used with many hydraulic tool attachments in almost any environment including hazardous and underwater.

These advantages and others are achieved, for example, by a hydraulic power pack system that includes a gas supply vessel containing high pressure compressed gas, a pneumatic manifold comprising a first control valve and a second control valve, a first stage intensifier, a second stage intensifier, a hydraulic manifold, and a pilot line. The first and second control valves are configured to receive the compressed gas from the gas supply vessel. The first stage intensifier includes a first pneumatic cylinder connected to the first and second control valves, a first hydraulic cylinder axially connected to the first pneumatic cylinder, a first pneumatic piston disposed in the first pneumatic cylinder, and a first hydraulic piston disposed in the first hydraulic cylinder and axially connected to the first pneumatic piston. The first control valve when actuated is configured to direct the compressed gas to the first pneumatic cylinder. The second stage intensifier includes a second pneumatic cylinder connected to the first and second control valves, a second hydraulic cylinder axially connected to the second pneumatic cylinder, a second pneumatic piston disposed in the second pneumatic cylinder, and a second hydraulic piston disposed in the second hydraulic cylinder and axially connected to the second pneumatic piston. The second control valve when actuated is configured to direct the compressed gas to the second pneumatic cylinder. The hydraulic manifold is configured to transfer hydraulic pressure in the first hydraulic cylinder or the second hydraulic cylinder to a tool cylinder that operates at least one tool coupled to the tool cylinder. The pilot line connects the first hydraulic cylinder to the second control valve. The second control valve is configured to be actuated by pressure in the first hydraulic cylinder.

The first stage intensifier may further include a first spring disposed in the first pneumatic cylinder under the first pneumatic piston. The first spring is configured to be compressed by the first pneumatic piston when the first pneumatic piston moves downward. The second stage intensifier may further include a second spring disposed in the second pneumatic cylinder under the second pneumatic piston. The second spring is configured to be compressed by the second pneumatic piston when the second pneumatic piston moves downward. The hydraulic manifold may include a shuttle valve connected to the tool cylinder, the first hydraulic cylinder and the second hydraulic cylinder. The shuttle valve is configured to allow fluid flow from a higher pressure of the first and second hydraulic cylinders to the tool cylinder.

The hydraulic power pack system may further include a backpack that contains the gas supply vessel, the pneumatic manifold, the hydraulic manifold, the first and second stage intensifiers, and the pilot line. The backpack is configured to be portably carried by a user. The hydraulic power pack system may further include an accumulator configured to store fluid and to supply the fluid for the first and second hydraulic cylinders to replace lost fluid.

These advantages and others are also achieved, for example, by a hydraulic power pack system that includes a gas supply vessel containing high pressure compressed gas, a pneumatic manifold comprising a control valve that is configured to receive the compressed gas from the gas supply vessel, an intensifier, a hydraulic manifold, and a backpack. The intensifier includes a pneumatic cylinder connected to the control valve, a hydraulic cylinder axially connected to the pneumatic cylinder, a pneumatic piston disposed in the pneumatic cylinder, a hydraulic piston disposed in the hydraulic cylinder and axially connected to the pneumatic piston, and a spring disposed in the pneumatic cylinder under the pneumatic piston. The spring is configured to be compressed by the pneumatic piston when the pneumatic piston moves downward. The control valve when actuated is configured to direct the compressed gas to the pneumatic cylinder. The hydraulic manifold is configured to transfer hydraulic pressure in the hydraulic cylinder to a tool cylinder that operates at least one tool coupled to the tool cylinder. The backpack contains the gas supply vessel, the pneumatic manifold, the hydraulic manifold, and the intensifiers. The backpack is configured to be portably carried by a user.

BRIEF DESCRIPTION OF THE DRAWINGS

The preferred embodiments described herein and illustrated by the drawings hereinafter be to illustrate and not to limit the invention, where like designations denote like elements.

DETAILED DESCRIPTION

Figure 1:
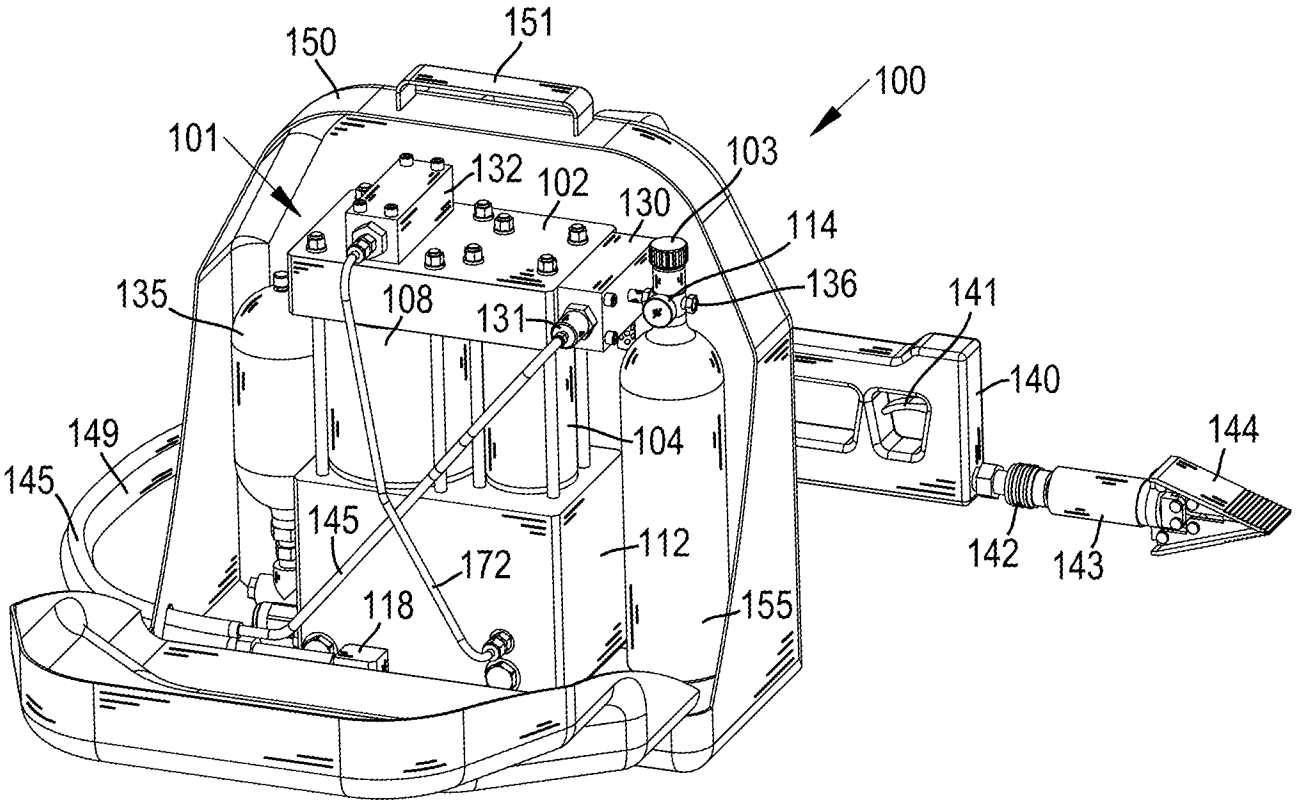
FIG. 1 is a perspective front view of the hydraulic power pack system in an open backpack of the disclosed invention.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

This novel system or device of the disclosed invention is a portable pneumatic/hydraulic intensifier pump that pressurizes hydraulic oil to a high pressure using a lower pressure supply of compressed gas via a pneumatic and hydraulic circuit with control valves and differential area pistons. This high pressure hydraulic oil then flows from a valve manifold through a hose that is attached to a hydraulic tool that is operated by a user. The differential area of the coupled gas and hydraulic pistons create a pressure intensification ratio which means it delivers a higher hydraulic output pressure than the input gas supply pressure. For example if the input piston to output piston area ratio was 2:1 then the output hydraulic fluid pressure would be two times the input gas pressure. The pistons differential area ratio can be changed to obtain the desired output hydraulic fluid pressure from the pneumatic gas supply pressure. Increasing the intensification ratio can be accomplished by increasing the diameter of the input piston and decreasing the diameter of the output piston. Higher intensification ratios increase the output to input pressure ratio of the coupled pistons, but higher ratios will decrease the output to input fluid volume of the pistons. To obtain the maximum required output pressure while also delivering enough fluid volume to the hydraulic tool the intensifier pistons sizing and ratios need to be correctly chosen.

The device in its current configuration is a portable gas powered or driven fixed volume positive displacement pump that produces high fluid pressures in a single fluid pumping direction and is small enough and light enough to be carried by the user in backpack. The device could be made to reciprocate and pump in two directions with higher flow rates but this would make the device larger and heavier which is not ideal for a light weight portable backpack unit. The device could include a single or multiple compressed gas or liquid $CO_2$ pressure vessels, a pneumatic input control circuit, one or more intensification piston stages, a hydraulic output control circuit, hydraulic fluid reservoir or accumulator, hydraulic hoses, fittings and couplers to connect the hoses to the user tool, and user controls. The pneumatic and hydraulic control circuits include but not be limited to check valves, pneumatic and hydraulic directional flow control valves, pressure control valves, safety relief valves, and pressure gauges.

With reference to FIG. 1, shown is a perspective front view illustrating an embodiment of device 100 of the disclosed invention with a two-stage intensifier device (or pump) 101 contained in an open backpack. Backpack 150 is designed to contain the intensifier device 101 and make it easy to carry either on a person's shoulders by shoulder straps (not shown in this view) or by handle 151. The intensifier device 101 is made of several pneumatic and hydraulic components that complete a fluid circuit that produces hydraulic fluid pressure and flow used to produce high forces by various hydraulic tool attachments. The components contained in backpack 150 are the two-stage intensifier device 101 that includes a pneumatic manifold 102, low pressure intensifier pneumatic cylinder 104, high pressure intensifier pneumatic cylinder 108, hydraulic manifold 112, control valve 130, valve actuator 131, pilot valve 132, gas supply vessel 155, pressure regulator 103, safety burst disc 136, accumulator 135, user control cable 145, hydraulic hose 149, and various pneumatic and hydraulic valves and fittings that complete the fluid circuit.

Hydraulic hose 149 is a flexible hose that connects hydraulic manifold 112 at output fitting 118 to handgrip 140 and tool cylinder 143. Hose 149 is a conduit that supplies fluid flow and pressure to and from tool cylinder 143, which extends or retracts its rod to apply force to the spreading wedge tool 144. Hose 149 connects to the aft end of a pipe that passes through user handgrip 140 and coupling 142 is mounted to the forward end of this pipe. Various tool configurations with many different functions can be used with the device 100, and a quick disconnect coupling 142 is mounted to the tool cylinder to be able to change tool attachments when desired. The quick disconnect coupling 142 includes a male and female fitting that allows hydraulic plumbing to be easily disconnected from hydraulic attachments without much fluid loss; these fittings are common to the industry and typically the male half of the fitting would be mounted to the end of hose and the female half of the fitting would be mounted to the attachment cylinder. The device illustrated in FIG. 1 has the male portion of coupling 142 mounted to user handgrip 140 and the female portion mounted to tool cylinder 143.

Control cable 145 connects to the aft end of user handgrip 140 and is coupled with a button or trigger 141 that is housed inside handgrip 140; when trigger 141 is depressed, cable 145 operates valve actuator 131 that shifts pneumatic valve 130, supplying gas to the pneumatic cylinders 104 and 108 which apply force to the hydraulic cylinders 107, 111 (see FIG. 7) and send high pressure hydraulic fluid to tool cylinder 143. After tool cylinder 143 has finished its operation and the user releases trigger 141 tool, cylinder 143 retracts and hydraulic fluid returns to the intensifier hydraulic cylinders 107, 111 for the next high pressure cycle. Tool cylinder 143 is classified as a single acting spring return hydraulic cylinder, which means hydraulic pressure and flow are delivered to the piston end of the cylinder to extend it and an internal spring is located on the rod end of the cylinder and applies the required force to retract the cylinder. Control cable 145 and valve actuator 131 are illustrated as mechanical devices but could easily be exchanged for wires and a battery operated electric solenoid actuator without changing the intended operation of the device 100.

The control valves connected to manifold 102 are a combination of pneumatic control valves that would most likely include but not limited to a manually or electrically operated directional valve 130, a piloted directional valve 132, inlet pressure regulator 103 and a safety pressure relief valve or burst disc 136. When the user actuates valve 130 and high pressure gas flows through the control valves and manifold 102, it is directed to the multistage intensifier cylinders. Each cylinder contains a set of axially coupled pistons (see FIG. 7), one being connected to the pneumatic circuit and another connected to the hydraulic circuit. The pneumatic piston 105, 109 diameters are larger than the coupled corresponding hydraulic piston 106, 110 diameters that they are coupled with which creates a differential area between the coupled pistons. The larger the differential area is between the coupled pistons results in a larger input to output pressure intensification ratio, which produces a higher output hydraulic pressure than the input pneumatic pressure.

The differential area ratio of the first stage intensifier driven by pneumatic cylinder 104 is less than the differential area ratio of the second stage intensifier driven by pneumatic cylinder 108; having two intensifier cylinders with different ratios will provide a larger volume of high pressure hydraulic fluid than what a single stage intensifier could provide to cylinder 143. The area ratio difference between the two intensification stages delivers a first stage high volume low pressure (2,000-5,000 psi range) fluid to tool cylinder 143 that pre-loads tool 144, as the tool load increases and the sequence pressure is reached the device transitions to the lower fluid volume higher pressure (5,000-10,000 psi range) second intensifier stage cylinder. The timing or sequence of the transition from the first to second stage intensifier cylinder is made by a pilot operated valve 132 that is part of the pneumatic circuit, which is actuated by a feedback pressure (pilot pressure) from the first stage of the hydraulic circuit. The pilot pressure setting can be adjusted to a higher or lower pressure to obtain the maximum number of pressure cycles per vessel 155 gas volume, which is a function of the applied tool load and fluid volume required to extend tool cylinder 143. The pilot pressure is delivered to valve 132 from the hydraulic circuit via pilot fluid line 172. The use of multiple intensification stages in device 100 increases the fluid volume delivered at lower pressures (up to 5000 psi) to quickly extend the operators tool 144 until it reaches a set resistance or force, this pre-loads tool 144 before the switch from the low pressure to the high pressure stage. Having two intensification stages increases the amount of fluid that can be delivered to tool cylinder 143 while also reducing the amount of supply gas expended per pressure cycle.

The hydraulic pressure supplied to tool cylinder 143 by the intensifier cylinders is maintained as long as the user depresses trigger 141 and control valve 130 is actuated or shifted to its second position. When valve 130 is released and shifts back to its first position the high pressure gas that is acting on the pneumatic pistons is allowed to vent to atmosphere and the pistons start retracting. This allows hydraulic fluid to reverse its flow from cylinder 143 which retracts or returns to its original un-pressurized state and will be ready for the next operation or pressure cycle.

Accumulator 135 is a fluid storage device that could be either an open (vented to atmosphere) or closed (not vented to atmosphere) design, its primary function is to store and replace fluid lost from the system possibly from a tool cylinder seal leak or from a leak at a hose connection or fitting. Accumulators typically use gas pressure or springs to apply a force to their internal partition which forces stored fluid from the accumulator 135 when system pressures are low. Accumulator 135 would also provide a place for the user to fill or add fluid to the system when low or empty and blead trapped air from the hydraulic circuit. If accumulator 135 is an open design, it would have an internal partition with fluid on one side of the partition and a spring on the side of the partition that was vented to atmosphere. If accumulator 135 is a closed design, it would not have a spring but would instead be charged with a low pressure gas and not be vented to atmosphere. The non-vented accumulator version would allow the system to be fully closed and used under water.

There are many hydraulic attachments and tools currently available in the market that could be used with the device 100 (e.g., cable or bolt cutters, spreading jaws, pressing and clamping cylinders, and lifting cylinders). Future novel specialty attachments and tools could be designed and tailored for use with the device 100. These high pressure low fluid volume hydraulic tools are generally designed with working pressures in the 10,000 psi range. The device 100 should be designed with fluid intensification ratios to deliver the required working pressure and volume required by the tool cylinder and its application.

Figure 2:
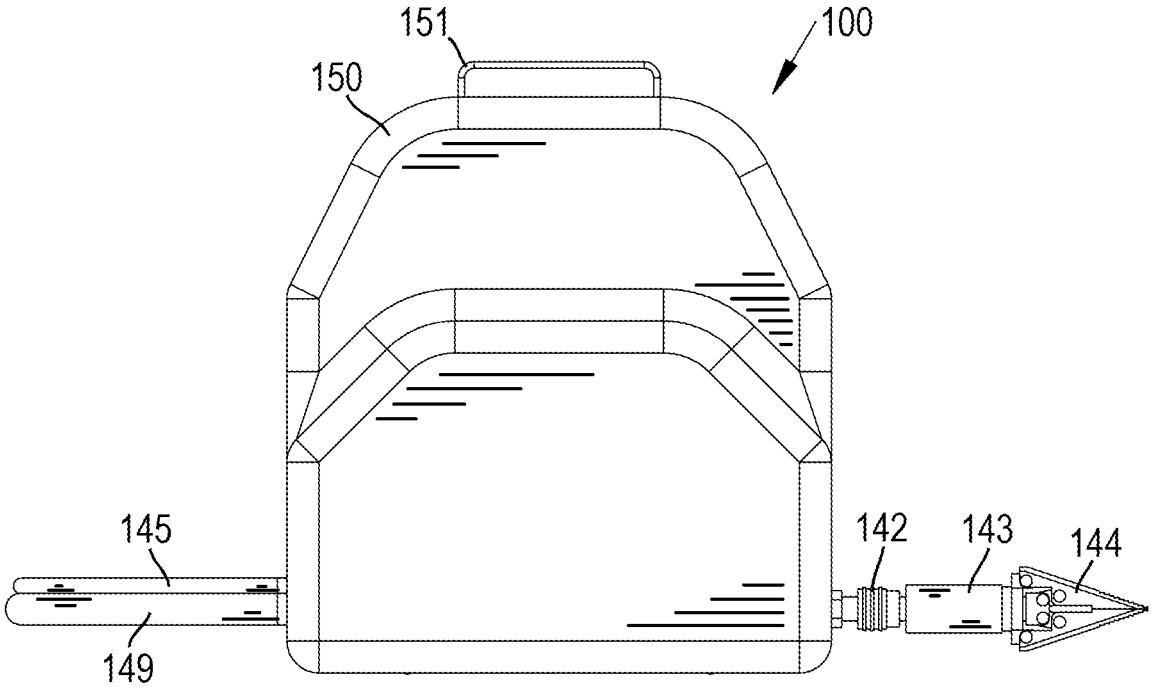
FIG. 2 is a front view of the hydraulic power pack system in a closed backpack of the disclosed invention.

With reference to FIG. 2, shown is a front view illustrating the device 100 with the front panel of backpack 150 closed with the intensifier device 101 contained inside. The backpack 150 has a handle 151 mounted at the top to carry the device 100 when not being worn on the user's shoulders. Hydraulic hose 149 and control cable 145 exit the backpack 150 at the lower left side of the backpack and both circle behind the backpack to the user handgrip 140 (see FIG. 1). The quick connect coupler 142, tool cylinder 143, and wedge tool 144 can be seen on the right hand side of the backpack 150. The position of the hose 149 and tool cylinder 143 could be switched to either side of backpack 150 to accommodate a left handed or right handed user.

Figure 3:
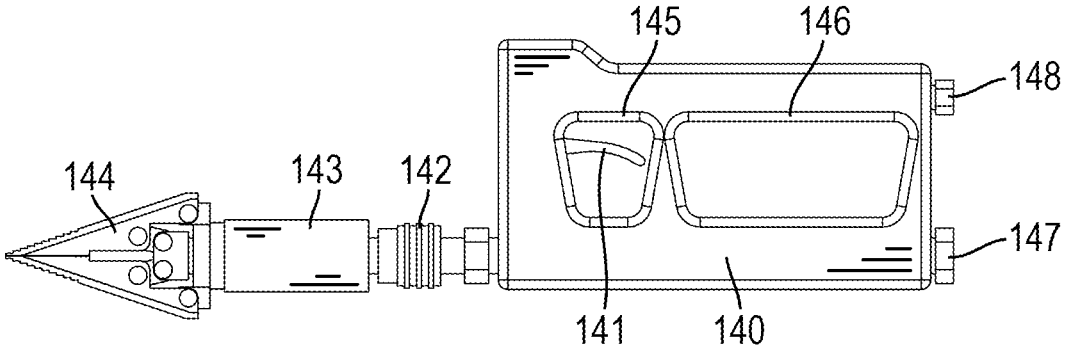
FIG. 3 is an elevated view of the user hand grip and a hydraulic wedge tool of the disclosed invention.

With reference to FIG. 3, shown is a side view that illustrates user handgrip 140 with tool cylinder 143 attached by a quick connect coupler 142 fitting. Handgrip 140 is equipped with a full grip hand hole 146 and a forward single finger hole 145 that contains the trigger 141. Housing the trigger in a separate finger hole should reduce a user from accidentally operating the tool. If required a secondary palm depression leaver could be added to further reduce the possibility of accidental operation. The aft end of handgrip 140 has a connection fitting 148 for the user control cable to attach and a connection fitting 147 for the hydraulic hose 149 to attach. Handgrip 140 is shown with the user cable connection fitting 148 above hose connection 147; this could be reversed if needed for better fitment of internal trigger parts or for a more ergonomic design of the handgrip.

Tool cylinder 143 and wedge tool 144 are provided as an assembly and when a different tool configuration is required both would be changed out by removing the tool cylinder assembly from handgrip 140 by separating the quick connect coupling 142. When a tool assembly is detached from handgrip 140 at the quick connect 142 fitting very little oil is lost, both the male and female halves of the fitting have a sealing feature much like a check valve; when the two halves are connected fluid flows though the fitting and when disconnected fluid is "checked" off and doesn't flow through. All extra tool cylinder attachments would be supplied with the female half of coupling 142 allowing fast tool interchangeability with low fluid losses. Wedge tool 144 shown here is typically used to spread and bend structures or breach or open locked doors.

Many different hydraulic cylinders and tool configurations are currently available in the market that could be used with this system, but specialized novel tools could be designed and optimized for use with the device 100 (e.g., cable or bolt cutters, bending and shearing tools, spreading jaws, clamping cylinders, and heavy structure lifting cylinders). This system 100 could also be designed for underwater use and novel specialty tools could be designed and tailored for this type of use. These high pressure low fluid volume hydraulic tools are generally designed for working pressures in the 10,000 psi range. The device 100 will be designed with a fluid intensification ratio to obtain the required working pressure of the tool cylinders and their applications.

Figure 4:
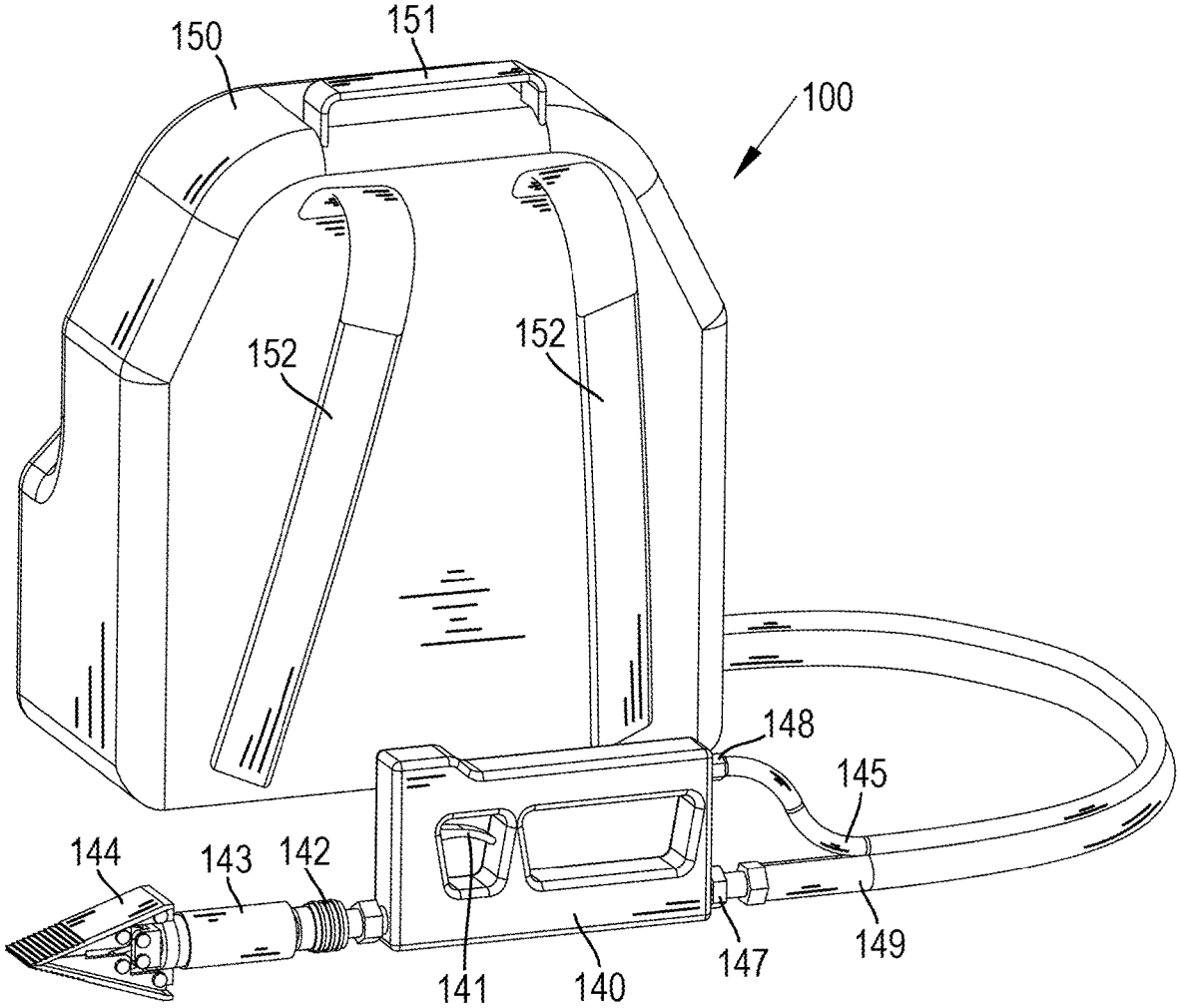
FIG. 4 is a perspective rear view of the hydraulic power pack system in a closed backpack of the disclosed invention.

With reference to FIG. 4, shown is a perspective view of backpack 150 that further illustrates its design with shoulder straps 152 attached to the backside of the backpack 150, and handle 151 being attached to the top of the backpack 150. Shoulder straps 152 would be made to adjust in length to fit various users' shoulder size. Hydraulic hose 149 and control line 145 are shown on the right side of the backpack 150, connecting handgrip 140 to the intensifier device contained inside the backpack. Handgrip 140 in this view would be held by the left hand of the user but could easily be changed for right handed use by routing hose 149 and control line 145 to the left hand side of backpack 150.

Figure 5:
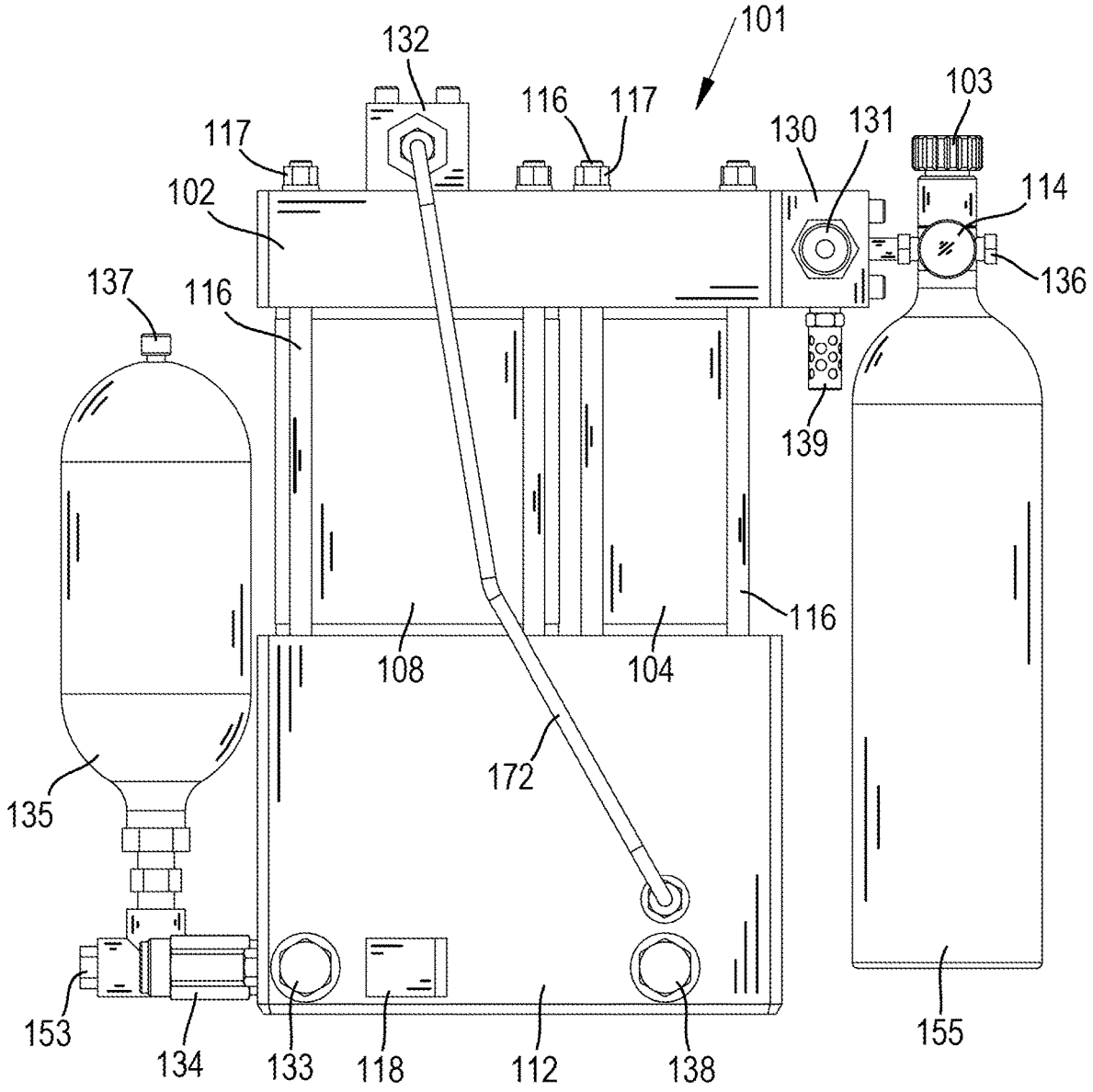
FIG. 5 is a front view of the intensifier pump of the disclosed invention.

With reference to FIG. 5, shown is a front view of a two-stage intensifier device 101 that illustrates the external locations for many of the components of the embodied device's pneumatic and hydraulic circuits. Manifold 102 and 112 are coupled to the top and bottom ends of pneumatic cylinders 104 and 108 and the assembly of these four components is held together by a plurality of threaded tie rods 116 and the tie rod nuts 117.

Pneumatic manifold 102 provides a mounting surface and closure for the top of pneumatic cylinders 104 and 108; manifold 102 also contains internal fluid passages that provide fluid communication between all the pneumatic circuit components and the cylinders. Manifold 102 has a directional valve 132 mounted on the top and directly above cylinder 108 and directional valve 130 mounted on the right side of the manifold. Valve 130 has a gas pressure regulator 103 mounted to its right side and a gas storage vessel 155 is mounted to the bottom of regulator 103. Pressure regulator 103 has a pressure gage 114 mounted on its front side and a safety burst disc 136 mounted on its right side. Valve 130 has an exhaust muffler 139 plumbed to an exhaust port that suppresses the sound of venting gas from the pneumatic circuit. Control valves 130 and 132 direct gas flow to and from the pneumatic cylinders to act on the pneumatic pistons to power the intensifier device. Cylinders 104 and 108 respectively contain pneumatic pistons 105, 109 that are axially coupled with the hydraulic pistons 106, 110 which are contained in hydraulic manifold 112 (see FIG. 7).

Gas supply vessel 155 is a high pressure storage vessel that contains and supplies high pressure compressed gas to the pneumatic circuit. The gas contained in storage vessel 155 could be of any suitable gas or air under high pressure (typically in the 800 psi to 4000 psi range) and could be in a gaseous or liquid state (e.g., liquid $CO_2$). When the gas pressure in vessel 155 falls below a usable pressure, it can easily be refilled or replaced with a spare vessel at full pressure.

Hydraulic manifold 112 provides a mounting surface and closure for the bottom of pneumatic cylinders 104 and 108; manifold 112 also contains the first and second stage hydraulic pistons and fluid passages that provide fluid communication between all the hydraulic circuit components and the cylinders. The fluid control valves and components that make up the hydraulic circuit that are illustrated here include shuttle valve 138, check valve 133, elbow fitting 118, pressure relief valve 134, and accumulator 135. Elbow fitting 118 can be installed with its outlet facing the left or right hand side of manifold 112 to allow the hydraulic hose 149 to exit the backpack on either side for left hand or right hand tool use. Hydraulic pilot line 172 connects the output of the first stage hydraulic cylinder to the pilot of pneumatic valve 132, when pilot pressure is high enough valve 132 will shift and send pressurized gas to the second stage pneumatic cylinder.

Accumulator 135 is a hydraulic fluid storage vessel with an internal partition that seals and separates hydraulic fluid from the gas side of the partition. Accumulator 135 can be configured as a vented to atmosphere device or a closed device depending on the setting of fitting 137. Fitting 137 is mounted on top of accumulator 135 and is in fluid communication with the gas side of the internal partition and can function two different ways depending on the embodied device's application performance and intended usage; one function of valve 137 would be to vent gas from the gas side of the partition to atmosphere, and the second would be to hold a low pressure gas charge on the gas side of the partition. The bottom end of accumulator 135 is the fluid side of the internal partition and contains hydraulic fluid which can be added or removed from the system depending on system pressure and the gas pressure acting on the gas side of the accumulator partition. Fitting 153 is on the hydraulic fluid side of the accumulator 135 partition and can be used to fill or drain the system of hydraulic fluid.

The illustrated locations of the pneumatic and hydraulic components and fittings on manifold 102 and 112 are for representation only; they could be moved to any location or to any external side of the device if needed to better facilitate the internal fluid passage connections with the valves and other components of the circuits. The functions and sequence of operation of the pneumatic and hydraulic valves and components will be fully described in following schematics of the embodied device circuit.

Figure 6:
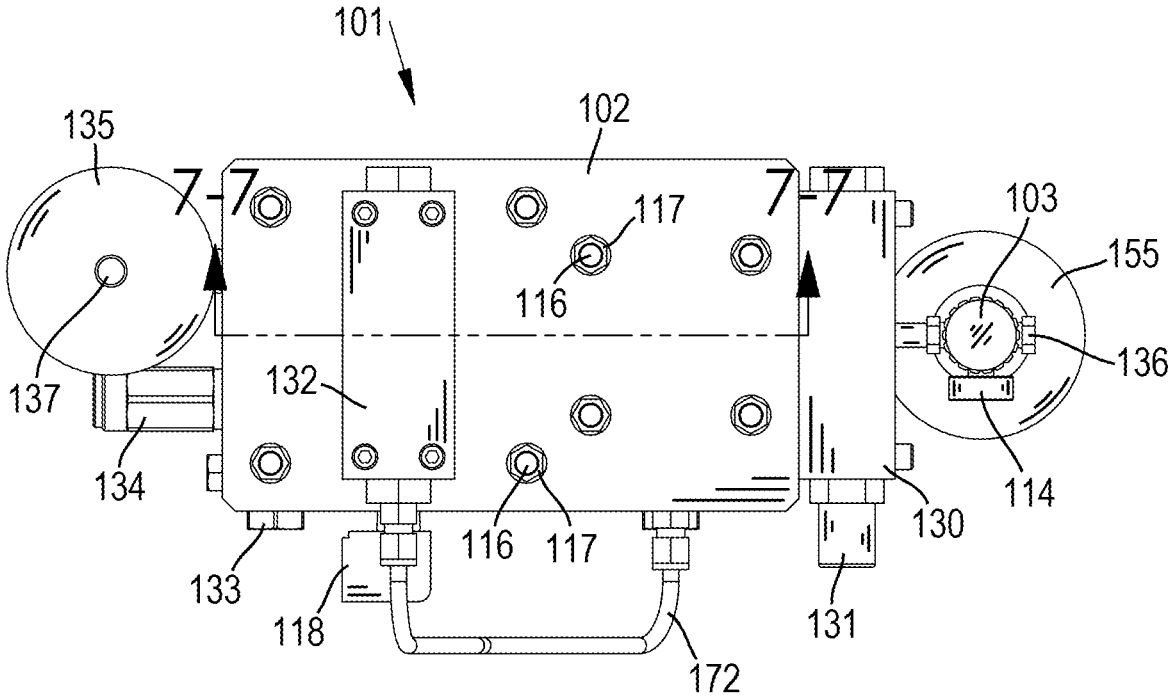
FIG. 6 is a top view of the intensifier pump of the disclosed invention.

With reference to FIG. 6, shown is a top view of intensifier device 101 that further illustrates the external locations of the embodied device's valves and other components. From this view, valve 132 is shown mounted to the top of manifold 102 directly above cylinder 108 and valve 130 is mounted on the right side of manifold 102. The locations of the pneumatic valves on manifold 102 can be changed if needed to better facilitate the placement of the internal plumbing passages between the pneumatic valves and the pneumatic cylinders.

Figure 7:
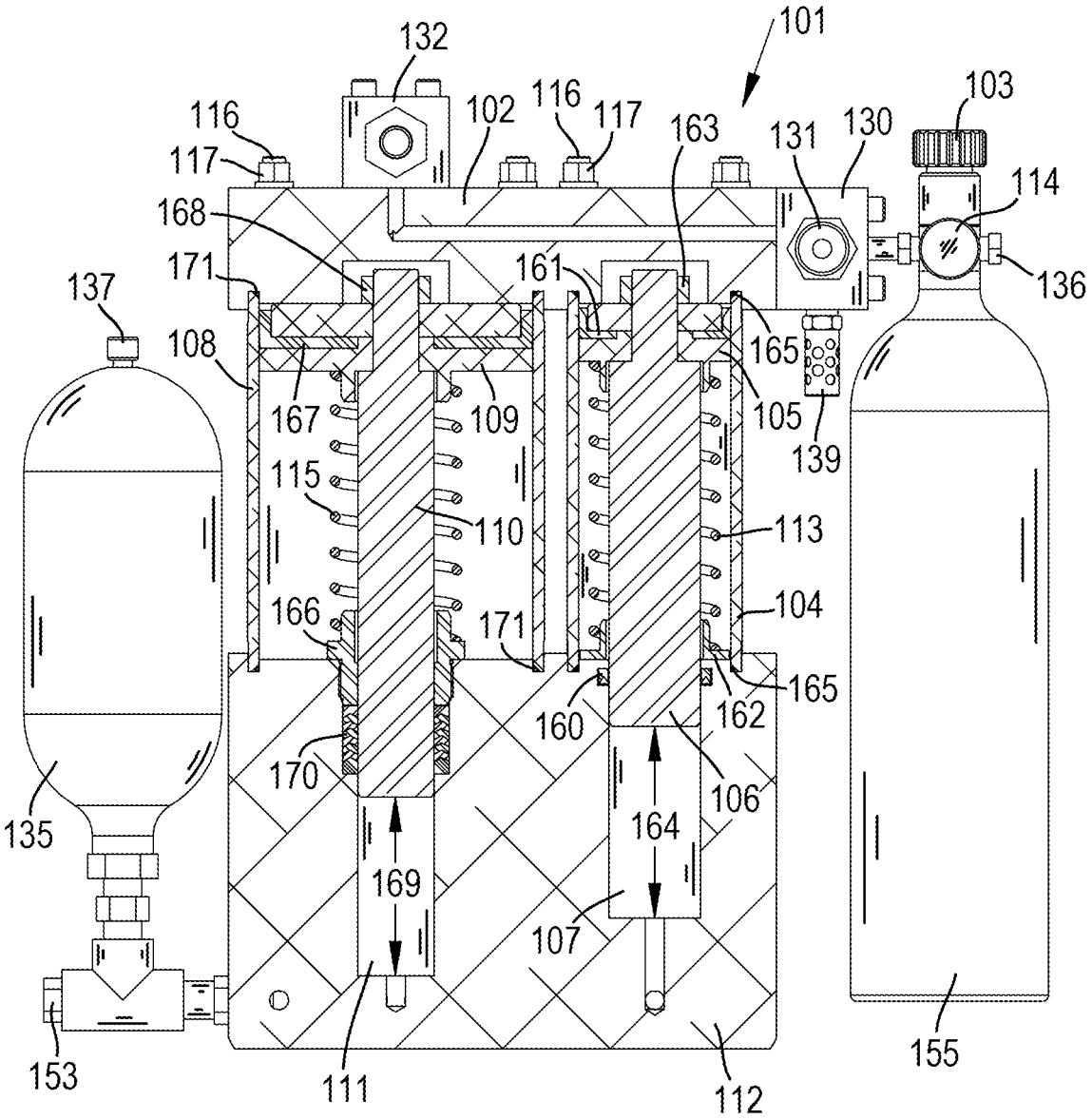
FIG. 7 is a cross-sectional view of the intensifier pump of the disclosed invention.

With reference to FIG. 7, shown is a section view taken about line 7-7 in FIG. 6 that illustrates the internal components of the two-stage intensifier device 101. Typically hydraulic and pneumatic cylinder construction includes a coupled piston and rod housed in a cylinder tube that is sealed or capped on both ends; on the forward rod end the cap is typically called a "head" and on the aft piston end it is called an "end cap." Cylinders typically have external plumbing with a pipe or tube attached to the cylinder head and end cap that supplies fluid to extend and retract the coupled piston and rod. Cylinder end caps are typically a solid construction that provides a mounting and sealing surface for the aft end of the cylinder tube; end caps are usually connected to an external load and provide an aft piston stop surface when fully retracted. The cylinder head provides a mounting and sealing surface for the forward end of the cylinder tube, and provides a forward piston stop surface when extended. Cylinder heads also have a central through hole with rod seals that is concentric with the cylinder tube that the piston rod passes through, allowing the rod to be connected to an external load. Both the end cap and head typically provide some plumbing ports to supply fluid flow to the rod end and piston end of the cylinder, and provide a place for threaded tension rods or "tie rods" and nuts or alternate way to hold the assembly together.

The two intensifier cylinders contained in device 101 are similar in construction to a typical cylinder with the exceptions of sharing a common end cap (pneumatic manifold 102), and share a common head (hydraulic manifold 112), and the pistons rods are used as hydraulic pistons (piston 106 and 110). The two pneumatic cylinders 104 and 108 are mounted between an aft pneumatic manifold 102 and forward hydraulic manifold 112, and the assembly is held together by a plurality of threaded tie rods 116 and nuts 117. Cylinders 104 and 108 are sealed on both ends by elastic O'ring type seals on the inside diameter of the bore that prevents gas leakage between the cylinders and the manifolds; cylinder 104 has tube seals 165 and cylinder 108 has tube seals 171. The benefit of having both intensifier cylinders sharing a common head and end cap is the internal manifold circuit plumbing or fluid passages for communication between the cylinders and valves; this reduces plumbing components, weight, and many potential leak points from fluid lines and fittings.

Both intensifier cylinders are a single action design with an internal return spring to retract the pistons after being extended and the pressure cycle is finished. The use of single action cylinders reduces supply gas usage which increases the number of pressure cycles that can be performed from a single full gas supply vessel 155; this reduces the amount of gas needed which also reduces the size and weight of the device making it more portable. One drawback of using single acting cylinders verses double acting is the reduction of hydraulic fluid volume delivered to the tool cylinder; if a higher volume system is required the intensifier cylinders could be modified to become double acting (although this would reduce the number of pressure cycles per gas vessel and would add some circuit complexity and weight to the system). Pistons 106 and 110 have a similar appearance as typical cylinder rods connected to pistons 105 and 109, but they are contained in cylinder bores and function as displacement pistons that pressurize and move fluid in and out of the hydraulic bores 107 and 111. Piston 106 has a seal 160 that stops leakage of hydraulic fluid into cylinder 104 and piston 110 has seal 170 that stops leakage of hydraulic fluid into cylinder 108.

The first stage cylinder 104 is noticeably smaller in diameter than the second stage cylinder 108 and in this figure it is located on the right hand side of the second stage cylinder. Both cylinders and their pistons are positioned parallel with each other, and each has similar construction and components. Hydraulic cylinders 107 and 111 are bored into hydraulic manifold 112 and fluid passages are drilled into the manifold to connect the cylinders with the hydraulic circuit and valves. Boring the hydraulic cylinder cavities in manifold 112 could be the preferred method of construction but if weight or manufacture cost could be reduced the construction could be changed to a cylinder tube and manifold design with threaded tie rods similar to the construction and assembly of the pneumatic cylinders 104 and 108 with manifold 102.

The first stage intensifier includes a pneumatic cylinder 104 that is concentric with and axially coupled with hydraulic cylinder 107. Pneumatic cylinder 104 contains pneumatic piston 105 that is axially coupled to the aft end of hydraulic piston 106 and is fastened to piston 106 by piston nut 163. The diameters of piston 105 and 106 can be changed to obtain the required output fluid pressure and volume from each stroke; the chosen diameters will be dependent on volume of vessel 155 and gas pressure available to drive piston 105. The stroke 164 of piston 105 and 106 can be made longer or shorter to deliver the required system fluid volume while also keeping the device as compact as possible. Piston 105 is equipped with elastic piston seal 161 that maintains a positive seal with the internal bore of cylinder 104 and prevents gas leakage from the aft end to the forward end of piston 105. Piston 105 is equipped with a return compression spring that is coupled to the forward end of piston 105 and to spring seat 162 at the aft end of the hydraulic cylinder 107. Spring seat 162 insures that spring 113 maintains its concentricity with hydraulic piston 106 and doesn't contact the piston during piston stroke. Cylinder 107 is equipped with an elastic medium pressure piston seal 160 at the aft end of the bore that maintains a positive seal with piston 106 and the bore, preventing hydraulic fluid leakage into the forward end of pneumatic cylinder 104. The first stage cylinder would typically produce between 2,000 psi and 5,000 psi hydraulic fluid pressure, and seal 160 and all other cylinder component materials will be selected to withstand the maximum pressure and stress produced by cylinder 107. Cylinder 104 and 107 and all the internal components of the cylinders should maintain good concentricity with one another providing low fiction operation without binding and prolong seal life.

The second stage intensifier includes a pneumatic cylinder 108 that is concentric with and axially coupled with hydraulic cylinder 111. Pneumatic cylinder 108 contains pneumatic piston 109 that is axially coupled to the aft end of hydraulic piston 110 and is fastened to piston 109 by piston nut 168. The diameters of piston 109 and 110 can be changed to obtain the required output fluid pressure and volume from each stroke; the chosen diameters will be dependent on vessel 155 volume and gas pressure available to drive piston 109. The stroke 169 of piston 109 and 110 can be made longer or shorter to deliver the required system fluid volume while also keeping the device as compact as possible. Piston 109 is equipped with an elastic piston seal 167 that maintains a positive seal with the internal bore of cylinder 108 and prevents gas leakage from the aft end to the forward end of piston 109. Piston 109 is equipped with a return compression spring 115 that is coupled to the forward end of piston 109 and to the aft end of seal gland 166. The spring seat on the aft end of seal gland 166 insures that spring 115 maintains its concentricity with hydraulic piston 110 and doesn't contact the piston during piston stroke.

Cylinder 111 is equipped with a high pressure piston seal 170 at the aft end of the bore that maintains a positive seal with the piston 110 and the bore, preventing hydraulic fluid leakage into the forward end of pneumatic cylinder 108. High pressure seal 170 is made from a low elasticity material and requires a removable seal gland 166 to ease installation of the seal and support the seal while exposed to high pressures. Installation of seals 170 into cylinder bore 111 would be done first followed by seal gland 166 being threaded into the cylinder bore to support and retain the aft end of seals 170. The second stage cylinder would typically produce between 5,000 psi and 10,000 psi of hydraulic fluid pressure, and seal 170 and all other cylinder component materials will be selected to withstand the maximum pressure and stress produced by cylinder 111. Cylinders 108 and 111 and all the internal components of the cylinders should be held concentric with one another to providing low fiction operation without binding and prolong seal life.

Figure 8:
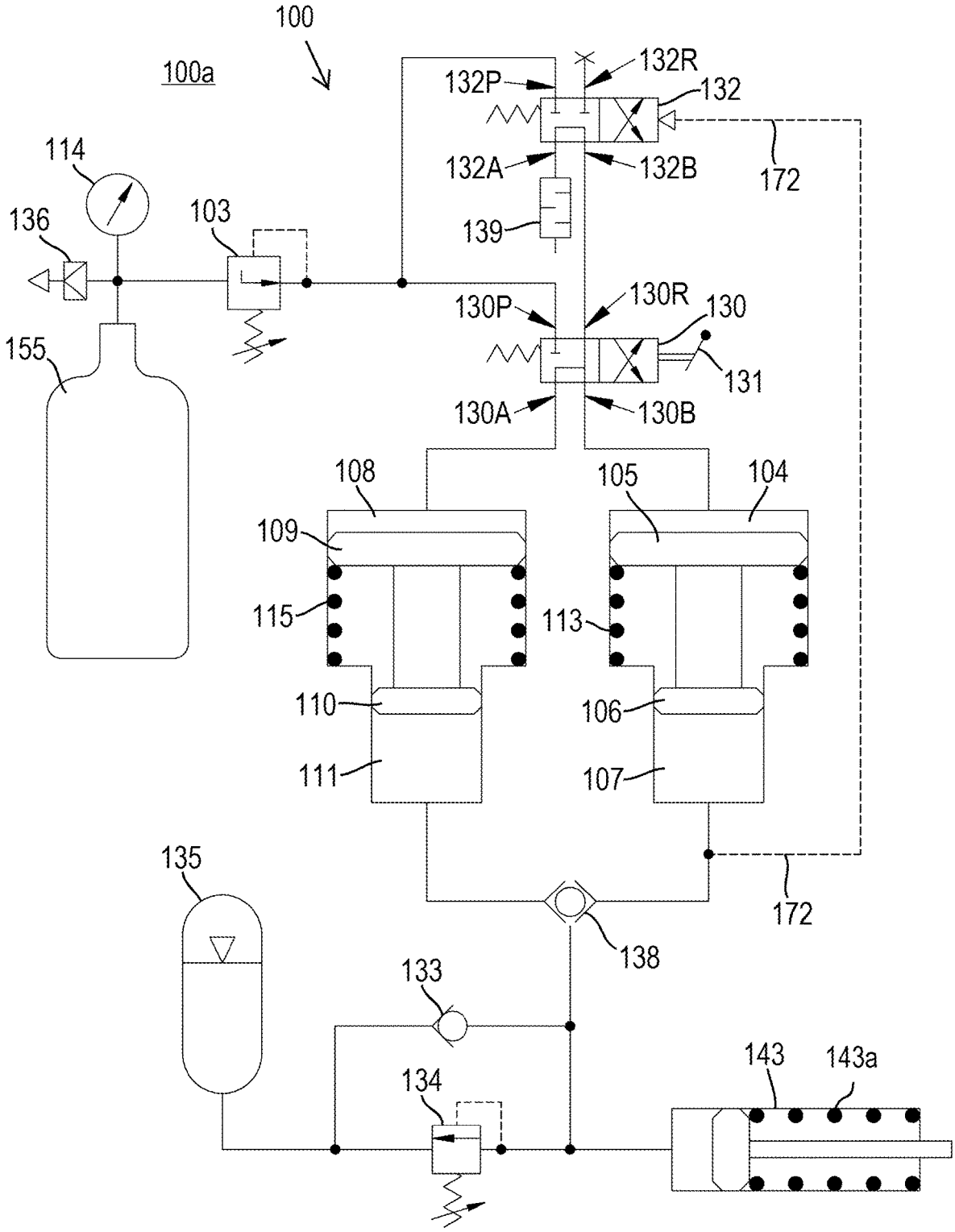
FIG. 8 is a circuit schematic of a two-stage intensifier pump of the disclosed invention.

With reference to FIG. 8, shown is a diagram or schematic representation of an embodiment of pneumatic and hydraulic circuit 100*a* for the two-stage hydraulic pressure intensifier device 101 that is illustrated in FIGS. 1, 5, 6, and 7; that contains but not limited to a gas supply vessel 155, several hydraulic and pneumatic valves and regulators, pneumatic cylinders 104 coupled to hydraulic cylinder 107, and pneumatic cylinder 108 coupled to hydraulic cylinder 111, and fluid flow paths to connect all components. Industry standard pneumatic and hydraulic symbols are used to depict the circuit components and one skilled in the art should be able to understand its layout and operation.

The device 100 may include two circuits with isolated fluids that transmit pressure to each other through two stages of axially coupled pistons contained in cylinders of different diameters; each having a pneumatic piston that is in contact with a gas (pneumatic circuit) and being of a larger diameter than the hydraulic piston that is in contact with a fluid (hydraulic circuit) creating a pressure intensifying circuit. The fluids of the circuits do not mix but do transmit pressure and flow to each circuit via the coupled pistons contained in the pressure intensifying cylinders. Each intensifier cylinder has a pneumatic piston of a given diameter that is axially coupled to a smaller diameter hydraulic piston. Stage one intensifier includes pneumatic piston 105 contained in cylinder 104 and hydraulic piston 106 contained in cylinder 107; stage two intensifier includes pneumatic piston 109 contained in cylinder 108 and hydraulic piston 110 contained in cylinder 111. When high pressure gas is applied to the pneumatic piston of each intensifier cylinder, an axial force is created and transmitted to the smaller diameter hydraulic pistons; the force on the hydraulic piston is transmitted into the hydraulic fluid thereby increasing the pressure of the hydraulic fluid in the hydraulic circuit to a higher pressure than the supplied gas pressure of the pneumatic circuit.

The diameter of piston 105 being larger than the diameter of piston 106 creates a differential area between the two coupled pistons. The larger the differential area between the two coupled pistons results in a larger pressure intensification ratio of the input to output pressures. A two-to-one (2:1) intensification ratio or area ratio would result in the output hydraulic pressure produced by piston 106 being two times higher than the input gas pressure acting on piston 105. The device intensification ratios can be changed to obtain almost any fluid pressure ratio within system material design strength limitations, allowing it to be tailored to various applications and requirements.

The differential area ratio between the stage one pistons 104 and 106 should be less than the differential area ratio of the stage two pistons 109 and 110. The area ratio difference between the two intensification stages provides a first stage high volume low pressure fluid flow to the cylinder 143 that transitions to a second stage low volume higher pressure fluid flow to cylinder 143 during high tool force requirements. The reason for multiple stages is to provide a larger fluid volume at a lower pressure to quickly extend cylinder 143 at lower tool loads until it reaches a set resistance or force, this pre-loads cylinder 143 during the pressure cycle and conserves supply gas.

The circuit is a bidirectional flow type, meaning that during the pressure cycle pressurized hydraulic fluid flows through the circuit paths in one direction from cylinders 107 and 111 to tool cylinder 143 and extends it, when the system is depressurized fluid flows in the opposite or reverse direction using the same paths to empty and retract cylinder 143 while refilling cylinder 107 and 111. Cylinders 104, 108, and tool cylinder 143 have internal springs that apply a force to help return or retract the pistons and rods to their original positions after extending during the pressure cycle. Detailed circuit design, device operation, pneumatic and hydraulic flow directions and sequences will be provided in the following sections.

Pneumatic Circuit

The main components of the pneumatic portion of the circuit include a gas supply vessel 155, pressure regulator 103, pressure gauge 114, overpressure safety burst disc 136, directional control valves 130 and 132, pneumatic cylinder 104 containing piston 105 and spring 113, pneumatic cylinder 108 containing piston 109 and spring 115, and a manifold (not shown) with internal fluid communication passages. The manifold provides a mounting surface or cavity for all the pneumatic circuit components and provides fluid communication between all the components and the two pneumatic cylinders.

Gas supply vessel 155 is a high pressure storage vessel that contains and supplies high pressure compressed gas to the pneumatic circuit. The gas contained in storage vessel 155 could be of any suitable gas or air under high pressure and could be in a gaseous or liquid state (e.g., liquid $CO_2$). When the gas pressure in vessel 155 falls below a usable pressure, it can easily be refilled or replaced with a spare vessel at full pressure. A pressure gauge 114 is mounted between gas vessel 155 and pressure regulator 103 that allows the user to see the current gas pressure in vessel 155. Pressure regulator 103 allows adjustment of the system pressure by reducing the high pressure supply gas contained in vessel 155 to the lower system operating pressure. Vessel 155 and regulator 103 could be of novel design or similar in design as ones currently used with recreational paintball guns. Pressure regulator 103 is equipped with a safety burst disc 136 that protects vessel 155 from being over pressurized; over pressurization could happen if the vessel was full and left in a high heat environment for extended periods.

Two directional control valves are plumbed downstream of regulator 103. Valve 130 is a two position spring returned manual or electrically actuated valve and valve 132 is a two position spring returned pilot actuated valve. Control valves 130 and 132 work in concert to supply and vent pressurized gas to cylinders 104 and 108. Control valve 130 has a two position internal port connection configuration with a first position having pressure port 130P blocked and the cylinder ports 130A and 130B connected to a vent port 130R; and a second position with port 130P connected to port 130B, and the port 130R connected to port 130A. In FIG. 8, the left box of the control valve 130 represents the first position and the right box of the control valve 130 (with crossed arrows) represents the second position. Control valve 130 is shifted to its second position when the user presses a leaver or button 141 on the control handgrip 140, connected to valve actuator 131. Control valve 132 has a two position internal port configuration with a first position having pressure port 132P and vent port 132R blocked, and port 132A connected to port 132B; and a second position with port 132P connected to port 132B, and port 132A connected to port 132R. In FIG. 8, the left box of the control valve 132 represents the first position and the right box of the control valve 132 (with crossed arrows) represents the second position. Valve port 132R is externally blocked as it is not needed, which prevents gas from being vented to atmosphere while valve 132 is shifted to its second position. Control valve 132 is shifted to its second position when the set "sequence" or pilot pressure is supplied to the valves pilot actuator via line 172 that is plumbed to the hydraulic output line of cylinder 107. Valve 132 acts as a sequence valve to shift the system pressure and flow from the first stage cylinder 104 to the second stage cylinder 108, when the desired hydraulic sequence pressure is reached.

Valves 130 and 132 would most likely be of a two position "spool" design with internal port connections that depend on spool design and the spools current position within the valve body. The internal port connections of valve 130 and 132 are shown in their "normal" or first positions in FIG. 8. When both valves 132 and 130 are in their first positions gas pressure to the system is not allowed or blocked and both cylinders 104 and 108 are vented to atmosphere. Depending on positions, these two valves work in concert to deliver the needed pneumatic gas flow and pressure to or from cylinders 104 and 108. Valve 132 is equipped with a muffler 139 connected to port 130A which is used to reduce or suppress the sound of venting high pressure gas exiting from cylinders 104 and 108, when valves 130 and 132 are shifted back to their normal positions and pistons 105 and 109 are retracting. Control valve 130 and 132 may have alternate internal port connections and flow paths than illustrated in FIG. 8 and could be two, three or four position valves if additional circuit flow paths are needed to operate device 100 as intended.

Hydraulic Circuit

The main components of the hydraulic portion of the circuit are the hydraulic cylinder 107 containing piston 106, hydraulic cylinder 111 containing piston 110, shuttle valve 138, safety relief valve 134, accumulator check valve 133, accumulator 135, and tool cylinder 143. Hydraulic cylinders 107 and 111 are plumbed in parallel with each other in the hydraulic circuit and each contains a hydraulic piston 106 and 110 that is axially coupled with the pneumatic pistons. Piston 106 in cylinder 107 is larger in diameter than piston 110 in cylinder 111; making the output volume produced by cylinder 107 greater than cylinder 111, but at a lower output pressure than cylinder 111. Increasing the pressure intensification ratio of a cylinder reduces its output fluid volume delivered to the hydraulic circuit per piston stroke. Piston 106 and 110 diameters and their cylinder strokes need to be sized correctly to deliver a high enough pressure with sufficient fluid volume to fully extend tool cylinder 143. The required second stage piston 110 diameter and stroke is mostly determined by the maximum operating pressure of tool cylinder 143; while the required first stage piston 106 diameter and stroke is mostly determined by the maximum fluid volume needed by tool cylinder 143 when fully extended. The exact sizing of the two intensifier cylinders will be tailored to the needs of the specific pressure and fluid volume required by the tool cylinder for the given application.

When pressurized gas is supplied to cylinders 104 and 108, an axial force is transmitted from the pneumatic pistons to the hydraulic pistons; this force is converted into fluid pressure in the hydraulic circuit which is equal to the force applied times the area of the hydraulic pistons. As an example, if an application needed 10,000 psi delivered to the tool cylinder and 800 psi gas pressure was available, one possible combination of intensification ratios would be 2.5:1 for the first stage and 12.5:1 for the second stage. This would deliver up to 2,000 psi fluid to the tool cylinder during the operation of the first stage and would sequence to the second stage between 1,800 and 1,900 psi to the second stage that would deliver up to 10,000 psi. Having two intensifier stages increases the volume of hydraulic fluid delivered to cylinder 143 during low tool loads before the high pressure low volume second stage is required.

Downstream of the hydraulic cylinders 107 and 111 outlet is a shuttle check valve 138 plumbed in the circuit that isolates the output flow of cylinders 107 and 111 from the rest of the circuit and tool cylinder 143. Shuttle check valve 138 only allows flow from the higher pressure of the two cylinders 107, 111 to be connected to the tool cylinder 143 at any given time during a pressure cycle. Shuttle valve 138 prevents any backflow to the lower pressure intensifier cylinder by blocking or "checking" (e.g., similar to a check valve) it off from the current higher pressure intensifier cylinder. Backflow from one intensifier cylinder to the other during the pressure cycle would result in a waste of supply gas if vented before the pressure cycle was finished and could also inadvertently increase the gas pressure of the pneumatic circuit above the system working pressure (possibly resulting in the safety burst disc venting supply gas). Neither outcome is desirable. When gas is vented form cylinder 104 and 108 and hydraulic pressure equalizes between cylinder 107 and 111, shuttle valve 138 would return to center allowing fluid to reverse flow, empting tool cylinder 143 and filling cylinder 107 and 111 for the next pressure cycle.

In another embodiment, check valves (not shown) may be used instead of the shuttle valve 138 to provide utilities similar to those of the shuttle valve 138. For example, a combination of check valves individually coupled to the hydraulic cylinders 107, 111 may be used to direct flow from the higher pressure of the two intensifier cylinders 107, 111 to the tool cylinder 143 at any given time during a pressure cycle and to prevent backflow to the lower pressure intensifier cylinder.

Downstream of shuttle valve 138, the hydraulic circuit has a relief valve 134 and a check valve 133 plumbed in parallel between accumulator 135 and tool cylinder 143. Relief valve 134 is a safety device that relieves hydraulic fluid to accumulator 135 in case of an overpressure event in the hydraulic circuit. Check valve 133 is plumbed in parallel with relief valve 134 blocking high pressure hydraulic fluid from entering accumulator 135 during the pressure cycle. After the pressure cycle is over and system pressure drops, check valve 133 opens and allows any relieved fluid to escape from accumulator 135 back to the hydraulic circuit, and return to cylinders 107 and 111 for the next pressure cycle.

Accumulator 135 is a multifunctional storage vessel, holding an extra volume of fluid in case of small leakages from fittings and the rod seals of the tool cylinder 143 and storing any fluid that has to be relieved by valve 134. If the system runs low on fluid from external leakage accumulator 135 will replace the lost fluid with some of its stored reserve fluid. In the event that all the extra fluid is exhausted from accumulator 135, it can be partially refilled to a specified volume, while conserving some empty space or volume for the relief valve 134 to function properly. Accumulator 135 could be designed as an open (e.g. vented to atmosphere) or closed gas charged (e.g. not vented to atmosphere) fluid storage device, and could have a internal elastic bladder or a ridged piston partition that separates the gas from the stored fluid. If not vented, one side of the internal partition would be charged with a low pressure gas and the side of the partition connected to the hydraulic circuit would be filled with hydraulic fluid. This would allow the system to be closed and used under water. If the accumulator is a vented design, it would most likely have a piston partition with a spring on the vented side of the partition and hydraulic fluid on the side connected with the hydraulic circuit. Accumulator 135 would also serve as a place to hold and blead trapped air from the hydraulic circuit during system fluid charging. If it is found that the functions of a partitioned accumulator are not needed by the hydraulic circuit, accumulator 135 could be replaced with a single chamber light weight vented reservoir.

Tool cylinder 143 is a single acting spring return design having an internal spring on the rod end of the cylinder that applies a force to retract the piston and rod when not under pressure. When the user releases the trigger and the gas control valves vent pressure from cylinders 104 and 108, hydraulic pressure reduces and the spring force retracts cylinder 143; this forces the fluid that extended cylinder 143 to reverse its flow back to the hydraulic circuit, returning fluid to intensifier cylinders 107 and 111 for the next cycle.

Additional Control valves could be added or removed from the hydraulic and pneumatic circuits if needed to improve performance. Modifying the pneumatic and hydraulic components and circuits to improve the device performance will not change the system's intended use or purpose, or the novelty and design intent of the embodied device.

Tool Cylinder Extend/Pressure Cycle Sequence of Operations

When the user shifts valve 130 to its second position connecting port 130P to port 130B while valve 132 is in its first position, pressurized gas is allowed to flow from pressure vessel 155 through pressure regulator 103 to the first stage intensifier cylinder 104, while simultaneously venting gas from the second stage intensifier cylinder 108 through ports 130A, 130R, 132B, and 132A. Venting cylinder 108 at this time prevents it from applying pressure to the hydraulic circuit (which would override the lower pressure of cylinder 107 by shifting shuttle valve 138) before cylinder 107 is able deliver most, if not all, of its volume at pressures up to, for example, 5000 psi to extend tool cylinder 143 at low tool loads.

After the first intensifier stage supplies enough hydraulic fluid for cylinder 143 to extend and reach the required tool pre-load force, first stage hydraulic fluid typically in the 1,500 to 5,000 psi range is delivered by line 172 shifting valve 132 to its second position; this connects ports 132P to 132B supplying pressurized gas to valve ports 130R and 130A and the second stage cylinder 108. In other words, the control valve 132 is configured to be actuated when the pressure in the hydraulic cylinder 107 is higher than a predetermined pressure. The second stage intensifier increases the fluid pressure downstream of cylinder 111, which shifts shuttle valve 138 blocking flow to or from cylinder 107 and delivering 5,000 to 10,000 psi hydraulic fluid to tool cylinder 143 for the tool's high force application. The sequence or shifting pressure of valve 132 would most likely be between 1,500 to 3,000 psi, shifting pressures can be adjusted to optimize the system performance for a given applications force requirements.

The hydraulic pressure supplied to tool cylinder 143 is maintained as long as the user has the trigger 141 depressed and control valve 130 is shifted to its second position. When valve 130 is allowed to return to its first position, the high pressure gas that was acting on pistons 105 and 109 is allowed to vent to atmosphere though muffler 139 by connecting ports 130A and 130B to port 130R and hydraulic fluid pressure starts dropping in the circuit. As system pressure drops below the pressure produced by the cylinder spring forces of the intensifier pistons and cylinder 143 they begin retracting, allowing hydraulic fluid to reverse its flow from cylinder 143 back to cylinder 107 and 111, returning the pistons to their original un-pressurized state and ready for the next pressure cycle.

Figure 9:
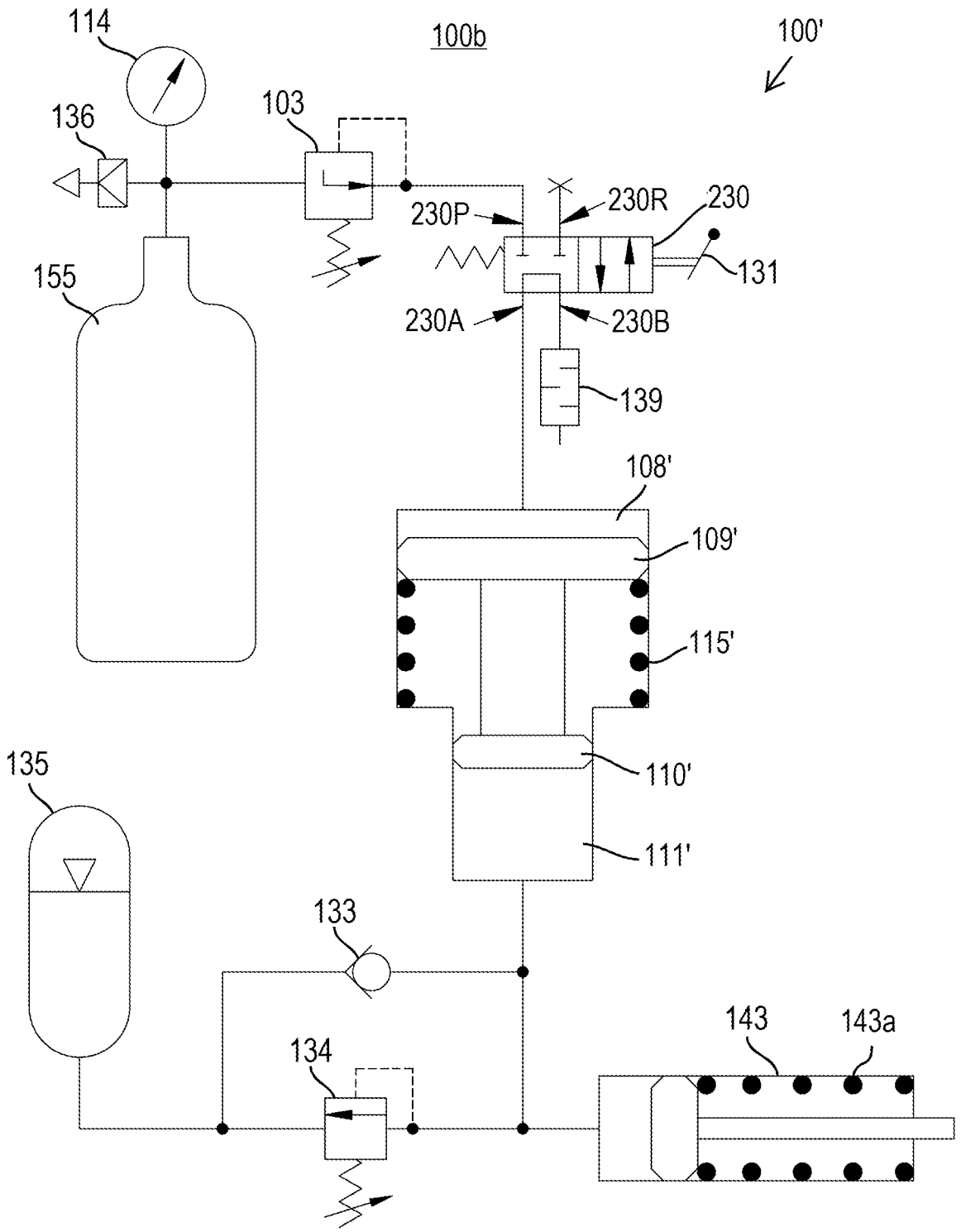
FIG. 9 is a circuit schematic of a single stage intensifier pump of the disclosed invention.

With reference to FIG. 9, shown is a diagram or schematic representation of another embodiment of the pneumatic and hydraulic circuit 100*b* for another embodiment of device 100'. Device 100' has a similar structure with device 100 that is illustrated in FIGS. 1, 5, 6, and 7. The device 100' however has a single stage intensifier device that includes pneumatic cylinder 108' and hydraulic cylinder 111', which are shown in the pneumatic and hydraulic circuit 100*b*. The schematic is of a single stage device that contains but not limited to a gas supply vessel 155, several hydraulic and pneumatic valves and regulators, pneumatic cylinder 108' coupled to hydraulic cylinder 111', and fluid flow paths to connect all components. Industry standard pneumatic and hydraulic symbols are used to depict the circuit components and one skilled in the art should be able to understand its layout and operation.

The device 100' may include two circuits with isolated fluids that transmit pressure to each other through axially coupled pistons contained in cylinders of different diameters; having a pneumatic piston that is in contact with a gas (pneumatic circuit) and being of a larger diameter than the hydraulic piston that is in contact with a fluid (hydraulic circuit) creating a pressure intensifying circuit. The fluids of the circuits do not mix but do transmit pressure and flow to each circuit via the coupled pistons contained in the pressure intensifying cylinders. The intensifier device of the device 100' includes pneumatic piston 109' contained in cylinder 108' that is axially coupled to hydraulic piston 110' contained in cylinder 111'. When high pressure gas is applied to the pneumatic piston 109' of the intensifier cylinder an axial force is created and transmitted to the smaller diameter hydraulic piston 110'; the force on the hydraulic piston 110' is transmitted into the hydraulic fluid thereby increasing the pressure of the hydraulic fluid in the hydraulic circuit to a higher pressure than the supplied gas pressure of the pneumatic circuit.

The diameter of piston 109' being larger than the diameter of piston 110' creates a differential area between the two coupled pistons. The larger the differential area between the two coupled pistons results in a larger pressure intensification ratio of the input to output pressures. A two-to-one (2:1) intensification ratio or area ratio would result in the output hydraulic pressure produced by piston 110' being two times higher than the input gas pressure acting on piston 109'. The device intensification ratios can be changed to obtain almost any fluid pressure ratio within system material design strength limitations, allowing it to be tailored to various applications and requirements.

The circuit is a bidirectional flow type, meaning that during the pressure cycle pressurized hydraulic fluid flows through the circuit paths in one direction from cylinder 111' to tool cylinder 143 and extends it, when the system is depressurized fluid flows in the opposite or reverse direction using the same paths to empty and retract cylinder 143 while refilling cylinder 111'. Cylinder 108' and tool cylinder 143 have internal springs 115', 143*a* that apply a force to help return or retract the pistons and rods to their original positions after extending during the pressure cycle. Detailed circuit design, device operation, pneumatic and hydraulic flow directions and sequences will be provided in the following sections.

Pneumatic Circuit

The main components of the pneumatic portion of the circuit include a gas supply vessel 155, pressure regulator 103, pressure gauge 114, overpressure safety burst disc 136, directional control valve 230, pneumatic cylinder 108' containing piston 109' and spring 115', and a manifold (not shown) with internal fluid communication passages. The manifold provides a mounting surface or cavity for all the pneumatic circuit components and provides fluid communication between all the components and the pneumatic cylinder.

Gas supply vessel 155 is a high pressure storage vessel that contains and supplies high pressure compressed gas to the pneumatic circuit. The gas contained in storage vessel 155 could be of any suitable gas or air under high pressure and could be in a gaseous or liquid state (e.g., liquid $CO_2$). When the gas pressure in vessel 155 falls below a usable pressure it can easily be refilled or replaced with a spare vessel at full pressure. A pressure gauge 114 is mounted between gas vessel 155 and pressure regulator 103 that allows the user to see the current gas pressure in vessel 155. Pressure regulator 103 allows adjustment of the system pressure by reducing the high pressure supply gas contained in vessel 155 to the lower system operating pressure. Vessel 155 and regulator 103 could be of novel design or similar in design as ones currently used with recreational paintball guns. Pressure regulator 103 is equipped with a safety burst disc 136 that protects vessel 155 from being over pressurized; over pressurization could happen if the vessel was full and left in a high heat environment for extended periods.

A directional control valve 230 is plumbed downstream of regulator 103. Directional control valve 230 is a two position spring returned manual or electrically actuated valve, which supplies and vents pressurized gas to cylinder 108'. Control valve 230 has a two position internal port connection configuration with a first position having pressure port 230P and port 230R blocked and the cylinder ports 230A and 230B connected; and a second position with port 230P connected to port 230A, and the port 230R connected to port 230B. In FIG. 9, the left box of the control valve 230 represents the first position and the right box of the control valve 230 (with parallel arrows) represents the second position. Valve port 230R is externally blocked as it is not needed and port 230B has muffler 139 externally mounted to it. Control valve 230 is shifted to its second position when the user presses a trigger (leaver or button) 141 on the control handgrip 140 connected to actuator 131.

Control valve 230 would most likely be of a two position "spool" design with internal port connections that depend on spool design and the spools current position within the valve body. The internal port connections of valve 230 are shown in their "normal" or first positions in FIG. 9. When valve 230 is in its first position, gas pressure to the system is blocked or not allowed, and cylinder 108' is vented to atmosphere. When valve 230 is in the second position, gas is allowed to flow to cylinder 108'. Muffler 139 connected to port 230A reduces or suppress the sound of venting high pressure gas exiting from cylinder 108' when valve 230 is shifted back to its normal position and piston 109' is retracting. Control valve 230 may have alternate internal port connections and flow paths than illustrated in FIG. 9 and could be a two, three or four position valve if additional circuit flow paths are needed to operate device 100' as intended.

Hydraulic Circuit

The main components of the hydraulic portion of the circuit are the hydraulic cylinder 111' containing piston 110, safety relief valve 134, accumulator check valve 133, accumulator 135, and tool cylinder 143. Hydraulic cylinder 111' contains hydraulic piston 110 that is axially coupled with the pneumatic piston 109'. Increasing the pressure intensification ratio of a cylinder reduces its output fluid volume delivered to the hydraulic circuit per piston stroke. Piston 110' diameter and cylinder stroke need to be sized correctly to deliver a high enough pressure with sufficient fluid volume to fully extend tool cylinder 143. The exact sizing of the intensifier cylinder will be tailored to the needs of the specific pressure and fluid volume required by the tool cylinder for the given application.

When pressurized gas is supplied to cylinder 108', an axial force is transmitted from pneumatic piston 109' to hydraulic piston 110'; this force is converted into fluid pressure in the hydraulic circuit which is equal to the force applied times the area of the hydraulic piston. As an example if an application needed 10,000 psi delivered to the tool cylinder and 800 psi gas pressure was available a pressure intensification ratio of 12.5:1 would be needed.

Downstream of cylinder 111', the hydraulic circuit has a relief valve 134 and a check valve 133 plumbed in parallel between accumulator 135 and tool cylinder 143. Relief valve 134 is a safety device that relieves hydraulic fluid to accumulator 135 in case of an overpressure event in the hydraulic circuit. Check valve 133 is plumbed in parallel with relief valve 135 blocking high pressure hydraulic fluid from entering accumulator 135 during the pressure cycle. After the pressure cycle is over and system pressure drops check valve 133 opens and allows any relieved fluid to escape from accumulator 135 back to the hydraulic circuit returning to cylinder 111' for the next pressure cycle.

Accumulator 135 is a multifunctional storage vessel, holding an extra volume of fluid in case of small leakages from fittings and the rod seals of the tool cylinder 143 and storing any fluid that has to be relieved by valve 134. If the system runs low on fluid from external leakage, accumulator 135 will replace the lost fluid with some of its stored reserve fluid. In the event that all the extra fluid is exhausted from accumulator 135, it can be partially refilled to a specified volume, while conserving some empty space or volume for the relief valve 134 to function properly. Accumulator 135 could be designed as an open (e.g. vented to atmosphere) or closed gas charged (e.g., not vented to atmosphere) fluid storage device, and could have an internal elastic bladder or a ridged piston partition that separates the gas from the stored fluid. If not vented, one side of the internal partition would be charged with a low pressure gas and the side of the partition connected to the hydraulic circuit would be filled with hydraulic fluid. This would allow the system to be closed and used under water. If the accumulator is a vented design it would most likely have a piston partition with a spring on the vented side of the partition and hydraulic fluid on the side connected with the hydraulic circuit. Accumulator 135 would also serve as a place to hold and blead trapped air from the hydraulic circuit during system fluid charging. If it is found that the functions of a partitioned accumulator are not needed by the hydraulic circuit, accumulator 135 could be replaced with a single chamber light weight vented reservoir.

Tool cylinder 143 is a single acting spring return design having an internal spring 143*a* on the rod end of the cylinder that applies a force to retract the piston and rod when not under pressure. When the user releases the trigger 141 and the gas control valve 230 vents pressure from cylinder 108', hydraulic pressure reduces and the spring force retracts cylinder 143; this forces the fluid that extended cylinder 143 to reverse its flow back to the hydraulic circuit, returning fluid to intensifier cylinder 111' for the next cycle.

Additional Control valves could be added or removed from the hydraulic and pneumatic circuits if needed to improve performance. Modifying the pneumatic and hydraulic components and circuits to improve the device performance will not change the system's intended use or purpose, or the novelty and design intent of the embodied device.

Tool Cylinder Extend/Pressure Cycle Sequence of Operations

When the user shifts valve 230 to its second position connecting port 230P to port 230A, pressurized gas is allowed to flow from pressure vessel 155 through pressure regulator 103 to intensifier cylinder 108' which applies a force to piston 111' that delivers up to 10,000 psi hydraulic fluid to cylinder 143. The hydraulic pressure supplied to cylinder 143 is maintained as long as the user has the trigger 141 depressed and control valve 230 is shifted to its second position. When valve 230 is allowed to return to its first position, the high pressure gas that was acting on piston 109' is allowed to vent to atmosphere though muffler 139 by connecting ports 230A to 230B, and hydraulic fluid pressure starts dropping in the circuit. As system pressure drops below the pressure produced by the cylinder spring forces of the intensifier piston and tool cylinder 143, they begin retracting, allowing hydraulic fluid to reverse its flow from tool cylinder back to cylinder 111', returning the pistons to their original un-pressurized state and ready for the next pressure cycle.

Since many modifications, variations, and changes in detail can be made to the described preferred embodiments of the invention, it is intended that all matters in the foregoing description and shown in the accompanying drawings be interpreted as illustrative and not in a limiting sense. Consequently, the scope of the invention should be determined by the appended claims and their legal equivalents.

What is claimed is:

1. A hydraulic power pack system, comprising:

a gas supply vessel containing high pressure compressed gas;

a pneumatic manifold comprising a first control valve and a second control valve, wherein the first and second control valves are configured to receive the compressed gas from the gas supply vessel;

a first stage intensifier comprising:

a first pneumatic cylinder connected to the first and second control valves, wherein the first control valve when actuated is configured to direct the compressed gas to the first pneumatic cylinder;

a first hydraulic cylinder axially connected to the first pneumatic cylinder;

a first pneumatic piston disposed in the first pneumatic cylinder; and a first hydraulic piston disposed in the first hydraulic cylinder and axially connected to the first pneumatic piston;

a second stage intensifier comprising:

a second pneumatic cylinder connected to the first and second control valves, wherein the second control valve when actuated is configured to direct the compressed gas to the second pneumatic cylinder;

a second hydraulic cylinder axially connected to the second pneumatic cylinder;

a second pneumatic piston disposed in the second pneumatic cylinder; and a second hydraulic piston disposed in the second hydraulic cylinder and axially connected to the second pneumatic piston;

a hydraulic manifold configured to transfer hydraulic pressure in the first hydraulic cylinder or the second hydraulic cylinder to a tool cylinder that operates at least one tool coupled to the tool cylinder; and a pilot line connecting the first hydraulic cylinder to the second control valve, wherein the second control valve is configured to be actuated by pressure in the first hydraulic cylinder.

2. The hydraulic power pack system of claim 1 wherein the first stage intensifier further comprises a first spring disposed in the first pneumatic cylinder at a forward end of the first pneumatic piston, wherein the first spring is configured to be compressed by the first pneumatic piston when the first pneumatic piston moves forward, and wherein the second stage intensifier further comprises a second spring disposed in the second pneumatic cylinder at a forward end of the second pneumatic piston, wherein the second spring is configured to be compressed by the second pneumatic piston when the second pneumatic piston moves forward.

3. The hydraulic power pack system of claim 1 further comprising a backpack that contains the gas supply vessel, the pneumatic manifold, the hydraulic manifold, the first and second stage intensifiers, and the pilot line, wherein the backpack is configured to be portably carried by a user.

4. The hydraulic power pack system of claim 1 wherein the first pneumatic piston has a larger diameter than the first hydraulic piston, and the second pneumatic piston has a larger diameter than the second hydraulic piston.

5. The hydraulic power pack system of claim 1 wherein the second pneumatic piston has a larger diameter than the first pneumatic piston.

6. The hydraulic power pack system of claim 1 further comprising an accumulator configured to store fluid and to supply the fluid for the first and second hydraulic cylinders to replace lost fluid.

7. The hydraulic power pack system of claim 6 further comprising a check valve and a relief valve connected in parallel between the accumulator and the tool cylinder, wherein the check valve is configured to prevent high pressure fluid from entering the accumulator.

8. The hydraulic power pack system of claim 1 wherein the second control valve is configured to be actuated when the pressure in the first hydraulic cylinder is higher than a predetermined pressure.

9. The hydraulic power pack system of claim 1 wherein the first control valve is configured to be actuated by a user.

10. The hydraulic power pack system of claim 1 wherein the second stage intensifier is configured to provide higher hydraulic pressure to the tool cylinder than the first stage intensifier.

11. The hydraulic power pack system of claim 1 wherein the hydraulic manifold comprises a shuttle valve connected to the tool cylinder, the first hydraulic cylinder and the second hydraulic cylinder, and wherein the shuttle valve is configured to allow fluid flow from a higher pressure of the first and second hydraulic cylinders to the tool cylinder.

12. The hydraulic power pack system of claim 11 wherein the shuttle valve is configured to prevent a backflow to a lower pressure cylinder among the first and second hydraulic cylinders.

13. The hydraulic power pack system of claim 1 wherein the hydraulic manifold comprises check valves configured to transfer the hydraulic pressure in the first hydraulic cylinder or the second hydraulic cylinder to the tool cylinder.

14. The hydraulic power pack system of claim 1 wherein the first and second control valves are connected such that the second control valve when actuated directs the compressed gas to the second pneumatic cylinder through the first control valve.

15. The hydraulic power pack system of claim 1 wherein the second control valve is configured to vent gas from the first and second pneumatic cylinders to atmosphere when the first control valve is deactivated.

16. A hydraulic power pack system, comprising:

a supply vessel for supplying a high pressure gas to a pneumatic circuit, the pneumatic circuit comprising a control valve that is configured to receive the high pressure gas from the supply vessel;

an intensifier comprising:

a pneumatic cylinder connected to the control valve, wherein the control valve when actuated is configured to direct the high pressure gas to the pneumatic cylinder;

a hydraulic cylinder axially aligned to the pneumatic cylinder;

a pneumatic piston disposed in the pneumatic cylinder;

a hydraulic piston disposed in the hydraulic cylinder and axially aligned to the pneumatic piston; and a spring disposed in the pneumatic cylinder at a forward end of the pneumatic piston, wherein the spring is configured to be compressed by the pneumatic piston when the pneumatic piston moves forward;

a hydraulic circuit configured to transfer hydraulic pressure in the hydraulic cylinder to a tool cylinder that operates at least one tool coupled to the tool cylinder; and a backpack that contains the supply vessel, the pneumatic circuit, the hydraulic circuit, and the intensifiers, wherein the backpack is configured to be portably carried by a user.

17. The hydraulic power pack system of claim 16 wherein the pneumatic piston has a larger diameter than the hydraulic piston.

18. The hydraulic power pack system of claim 16 further comprising an accumulator configured to store fluid and to supply the fluid for the hydraulic cylinders to replace lost fluid.

19. The hydraulic power pack system of claim 18 further comprising a check valve and a relief valve connected in parallel between the accumulator and the tool cylinder, wherein the check valve is configured to prevent high pressure fluid from entering the accumulator.

20. The hydraulic power pack system of claim 16 wherein the control valve is configured to be actuated by a user.

21. The hydraulic power pack system of claim 16 wherein the control valve is configured to vent gas from the pneumatic cylinder to atmosphere when the control valve is deactivated.

22. The hydraulic power pack system of claim 16 wherein the supply vessel is configured to be replaceable and stores a substance in a liquid, gaseous, or mixed state for supplying the high pressure gas to the pneumatic circuit.

23. A hydraulic power pack system, comprising:

a supply vessel for supplying high pressure compressed gas to a pneumatic circuit comprising first and second control valves that are configured to receive the compressed gas from the gas supply vessel;

a first stage intensifier comprising:

a first pneumatic cylinder connected to the first and second control valves, wherein the first control valve when actuated is configured to direct the compressed gas to the first pneumatic cylinder;

a first hydraulic cylinder axially aligned to the first pneumatic cylinder;

a first pneumatic piston disposed in the first pneumatic cylinder; and a first hydraulic piston disposed in the first hydraulic cylinder and axially aligned to the first pneumatic piston;

a second stage intensifier comprising:

a second pneumatic cylinder connected to the first and second control valves, wherein the second control valve when actuated is configured to direct the compressed gas to the second pneumatic cylinder;

a second hydraulic cylinder axially aligned to the second pneumatic cylinder;

a second pneumatic piston disposed in the second pneumatic cylinder; and a second hydraulic piston disposed in the second hydraulic cylinder and axially aligned to the second pneumatic piston;

a hydraulic circuit configured to transfer hydraulic pressure in the first hydraulic cylinder or the second hydraulic cylinder to a tool cylinder that operates at least one tool coupled to the tool cylinder; and a pilot line connecting the first hydraulic cylinder to the second control valve, wherein the second control valve is configured to be actuated by pressure in the first hydraulic cylinder.

24. The hydraulic power pack system of claim 23 wherein a differential area ratio between the first pneumatic piston and the first hydraulic piston is less than a differential area ratio between the second pneumatic piston and the second hydraulic piston.

25. The hydraulic power pack system of claim 23 wherein the supply vessel is configured to be replaceable and the high pressure compressed gas is in a gaseous state and/or a liquid state.

26. The hydraulic power pack system of claim 23 wherein:

the first stage intensifier further comprises a first spring coupled with the first pneumatic piston to bias the first pneumatic piston toward a retracted position; and the second stage intensifier further comprises a second spring coupled with the second pneumatic piston to bias the second pneumatic piston toward a retracted position.

27. The hydraulic power pack system of claim 23 further comprising a backpack that contains the supply vessel, the pneumatic circuit, the hydraulic circuit, the first and second stage intensifiers, and the pilot line, wherein the backpack is configured to be portably carried by a user.

28. The hydraulic power pack system of claim 23 wherein the first pneumatic piston has a larger diameter than the first hydraulic piston, and the second pneumatic piston has a larger diameter than the second hydraulic piston.

29. The hydraulic power pack system of claim 23 wherein the second pneumatic piston has a larger diameter than the first pneumatic piston.

30. The hydraulic power pack system of claim 23 wherein the second control valve is configured to be actuated when the pressure in the first hydraulic cylinder is higher than a predetermined pressure.

31. The hydraulic power pack system of claim 23 wherein the first control valve is configured to be actuated by a user.

32. The hydraulic power pack system of claim 23 wherein the hydraulic circuit comprises check valves configured to transfer the hydraulic pressure in the first hydraulic cylinder or the second hydraulic cylinder to the tool cylinder.

33. The hydraulic power pack system of claim 23 wherein the first and second control valves are connected such that the second control valve when actuated directs the compressed gas to the second pneumatic cylinder through the first control valve.

* * * * *